United States Patent [19]

Sprague

[11] Patent Number: 4,979,425

[45] Date of Patent: Dec. 25, 1990

[54] ARMOR PLATE ASSEMBLY

[76] Inventor: Scott C. Sprague, Box M, Davenport, Calif. 95017

[21] Appl. No.: 263,727

[22] Filed: Oct. 28, 1988

[51] Int. Cl.[5] ..... F41H 5/02

[52] U.S. Cl. ..... 89/36.02; 273/396

[58] Field of Search ..... 2/2.5; 89/36.02, 36.04, 89/36.05, 36.06; 273/322, 395, 396, 410

[56] References Cited

U.S. PATENT DOCUMENTS

| | | | |
|---|---|---|---|
| 3,392,978 | 7/1968 | Weist, Jr. | 273/322 |
| 3,739,731 | 6/1973 | Tabar | 109/49.5 |
| 4,045,027 | 8/1977 | Manska | 273/96 R |
| 4,358,984 | 11/1982 | Winblad | 89/36.08 |
| 4,404,889 | 9/1983 | Miguel | 89/36.02 |
| 4,512,585 | 4/1985 | Baravaglio | 273/410 |
| 4,708,050 | 11/1987 | Hoskins | 89/36.04 |

FOREIGN PATENT DOCUMENTS

| | | | |
|---|---|---|---|
| 156204 | 5/1939 | Austria | 2/2.5 |

OTHER PUBLICATIONS

Arthur Crouch, Colliers, Sep. 1940.

*Primary Examiner*—Stephen C. Bentley
*Attorney, Agent, or Firm*—The Dulin Law Firm

[57] ABSTRACT

An armor plate assembly comprising a plurality of U-shaped or J-shaped redirecting members for intercepting and guidingly redirecting incoming small arms fire. The preferred embodiment comprises a closely packed, rigidly held array of tubular members, each tubular member having an intercepting opening and an exit opening directed away from the object to be protected. Three- or four-sided tensoidal deflectors are disposed adjacent the intercepting openings to protectively cover the interstitial gaps left between the closely spaced tubes and to further guide incoming fire into the redirecting members.

17 Claims, 2 Drawing Sheets

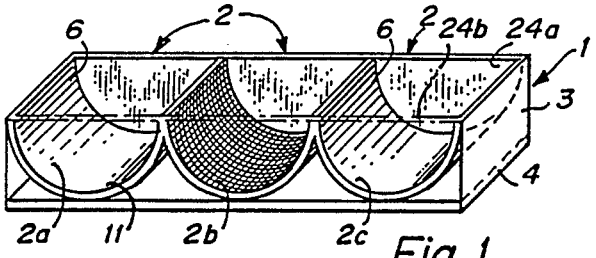
Fig_1
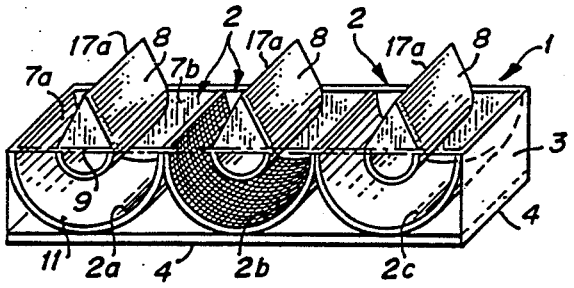
Fig_2A
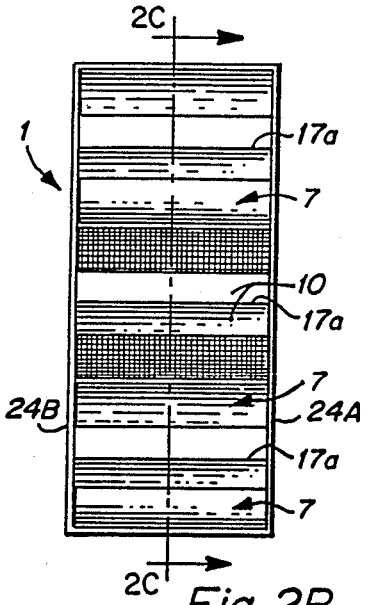
Fig_2B
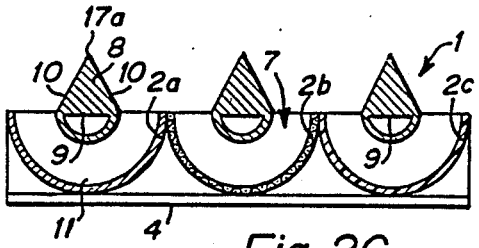
Fig_2C
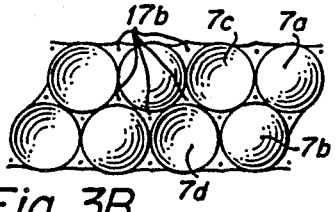
Fig_3B
Fig_3A
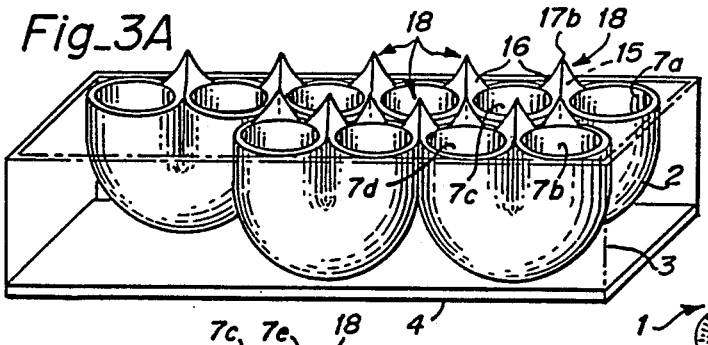
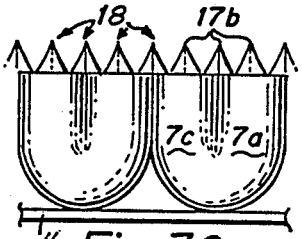
Fig_3C
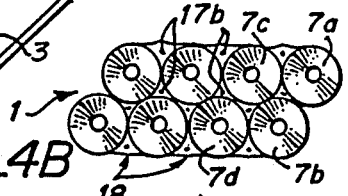
Fig_4B
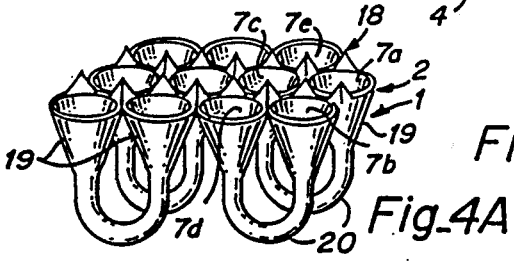
Fig_4A
Fig_4C
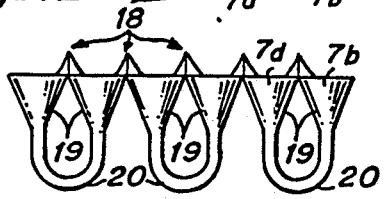

ARMOR PLATE ASSEMBLY

FIELD

This invention relates to armor plating assemblies, and more particularly to light weight armor plate assembly, which can be constructed of conventional materials and is characterized by means for redirecting incoming small arms fire so that the rounds are deflected away from an object to be shielded so that there is reduced armor-piercing directed impact. In a preferred embodiment, U-shaped or J-shaped tubular structures intercept and deflect incoming rounds back to the direction of fire or off at a harmless angle.

DEFINITIONS

As it relates to this application:

"Shadow Zone" means a safe region located behind the armor plate assembly, shielded from contact with either direct or deflected small arms fire.

"Triangular" as it relates to deflectors refers to the cross sectional view of each deflector and includes a two-sided A-frame (without the base) prismatic and tensoidal deflectors.

BACKGROUND

There are numerous types of armor plating assemblies which have been tried in the history of warfare, including fixed and portable shields of various sorts. Almost all of these rely on the principal of heaviness, hardness or thickness to directly absorb or fragment the impact of the bullet or other anti-personnel missiles (arrow, projectile or the like).

For example, sophisticated body armor comprising a series of built-up layers of nylon and KEVLAR which absorbs and spreads the bullet impact by virtue of use of spaced fibrous material is currently available. U.S. Pat. No. 4,404,889 (Miguel, 1983) discloses composite armor comprising layers of high density steel honeycomb, balsa wood, and ballistic-resistant nylon such as KEVLAR, sandwiched in various arrangements between outer layers of steel armor plate particularly adapted for use as the floor armor on military tanks for attenuating mine blast loading. Other types of more historic body armor include hardened structures such as suits of armor, hardened steel armor plate, woven or mesh material (e.g., chain mail) and the like.

For larger battle structures, such as tanks, personnel carriers, ships and bunkers, a variety of similar energy absorbing hardened materials have been used. These range from simply thick concrete to heavy armor plate, or laminated composite structures. A more recent development is the use of double wall for tank armor, the outer wall of which causes the incoming armor-piercing round to explode relatively harmlessly a few inches outwardly from the main structural wall of the tank. However, the counter to this is the development of two-part ammunition, wherein a first charge pierces the outer shell, permitting a main charge to subsequently impact the main structure of the tank through the hole produced in the outer wall by the first charge.

A second type of ammunition used which is capable of causing substantial damage to a combat vehicle is impact-fused ammunition. Impact-fused ammunition generally comprises a hollow shell made with an internal cone, directed forwards, which at the activation of a bursting charge, within the tip of the shell, gives rise to a jet directed forwards which is intended to cut through the vehicle armor plate.

U.S. Pat. No. 4,358,984 (Winblad, 1982) discloses an apparatus used to protect a combat vehicle such as a tank, from such impact-fused ammunition. Winblad teaches mounting an umbrellalike screen on the forward part of the main gun barrel of a tank to intercept and cause to detonate incoming impact-fused ammunition some distance away from the outer shell of the tank and provide dissipation of the charge before it reaches the armor. The detonator screen is an open mesh-work, preferably of chain links, that can be retracted against the gun barrel and has a mesh size open enough to permit vision by the tank driver and gunner, yet said to be sufficiently tight to be effective in intercepting a substantial percentage of incoming rounds.

The above mentioned references are related in that the armor plating assemblies employed are used for protection against specialized destructive ammunition (e.g. large arms fire, mine blasts, two-part charges, etc.). They also share the same disadvantages of relying on excessive bulk and thicknesses of material to perform the function of protection. They are often overkill and impractical for use in repelling small arms fire.

The handling and relatively safe disposal of explosives, such as bombs, is taught by U.S. Pat. No. 3,739,731 (Tabor, 1973). Tabor discloses an enclosure comprising a generally "elastic" support structure, having a suspended net therein, used for holding the explosive charge away from intimate contact with the support structure walls. The support structure is formed from a lamination of a suitable materials, such as fiberglass, and will de-laminate upon detonation of an explosive within its confines rather than break apart in the form of flying fragments. U.S. Pat. Nos. 3,392,978 (Weist, 1968); and 4,045,027 (Manaska, 1977) disclose game apparatus used to catch or redirect incoming game balls. These references show specially designed hand held game implements that have a specific amount of curvature enabling a player to catch and subsequently throw a ball, as in Weist, or merely deflect a spherical object in order to keep it in play, as in Manaska. These references teach the use of a single, handheld game device to receive or deflect an incoming relatively slow speed, soft ball, but in no way suggest a device as protection against incoming small arms fire.

Accordingly, there is a need for improved armor plating particularly adapted for use in small arms fire which can provide a variety of uses, ranging from personnel protection to protection for larger structures, such as vehicles, vessels, buildings, or emplacements.

THE INVENTION

Objects

It is among the objects of this invention to provide an improved armor plating assembly which is adaptable to a variety of protective uses, not only for personnel, but also for vehicles, vessels and building structures or emplacements, characterized by the use of means for redirecting incoming small arms fire to be returned to the incoming direction or directed harmlessly off to one or more sides.

BRIEF DESCRIPTION OF THE DRAWINGS

The principles of the invention are further illustrated in the drawings in which:

FIG. 1 is a perspective view of the redirecting armor plating assembly showing an array of side by side connected trough-like, U-section channels;

FIG. 2A is perspective view of a second embodiment of the invention showing an array of connected trough-like, U-section tubular channels each having a substantially equilateral triangular solid deflector with a base disposed at the top center of the U-section channel;

FIG. 2B is a top plan view of the redirecting armor plating of FIG. 2A;

FIG. 2C is a side section view of the redirecting armor plating assembly taken along line 2C—2C of FIG. 2B showing a series of connected U-section channels each having a substantially equilateral triangular deflector member disposed at the top center of each channel;

FIG. 3A is a perspective view of a third embodiment of the invention showing an array of U-shape round tubes with inverted deflector cone members occupying the interstices between adjacent tube openings, FIG. 3B is a top plan view of the third embodiment of the invention of FIG. 3A;

FIG. 3C is a side elevation view of the third embodiment of the invention of FIG. 3A;

FIG. 4A is a perspective view of a fourth embodiment of the invention showing an array of funnel-like members interconnected in pairs by a reduced diameter tube with inverted deflector cones occupying the interstices between adjacent funnel openings;

FIG. 4B is a top plan view cf the fourth embodiment of the invention of FIG. 4A:

FIG. 4C is a side elevation view of the fourth embodiment of the invention of FIG. 4A;

SUMMARY

Figure 5A:
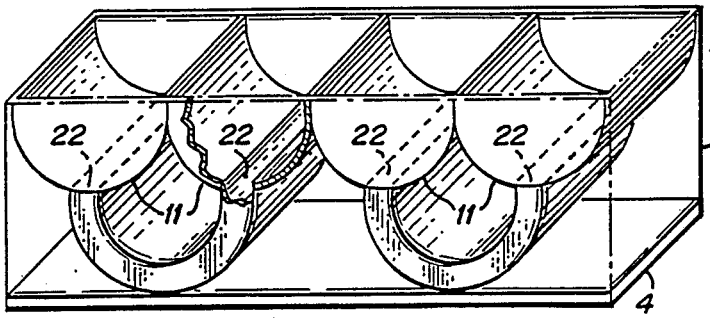
FIG. 5A is a perspective view of a fifth embodiment of the invention showing an array of trough-like, U-shaped channels of FIG. 1 having been joined at a slot in the bottom of each channel into pairs by a second array of trough-like U-shaped channels.

The invention comprises an armor plating assembly having a closely spaced, connected array of members, generally U-shaped in cross section, and which include deflector members in cases where the U-shaped members, due to the spacing of the array, have gaps therebetween. The deflectors may be generally triangular in cross-section with their base disposed to cover the gap. The open portion of the U-shaped members and points of the triangular deflectors are disposed in the direction of incoming fire. Incoming rounds of small arms fire are redirected either towards the original direction of fire or off at a harmless angle by entering the opening(s), or one of the openings of the U-section members, being deflected by the U-shaped member, and subsequently exiting, at a reduced velocity and/or energy, via the other opening(s) of each U-shape member. Projectiles that are directed towards the gaps of each U-shaped member are deflected into an opening by the pointed deflector members. Likewise, the deflectors may be placed above the bottom centers of the U-shaped members to prevent piercing by direct hits.

In the presently preferred best mode embodiment, the U-shaped members are round tubular channels having adjoining openings with appropriately disposed, generally pyramidal deflecting members covering the gaps (interstices) between adjoining openings of the U-shaped round tubular members. The pyramids, called "tensoids" herein, are three- or four-sided (not counting optional bases) pyramids having generally parabolic sides, concave up in section.

A second alternate embodiment comprises an closely spaced, connected array of troughs, semicircular or parabolic in cross-section, supported by a rigid framework and base structure. These may include prism shaped tensoids disposed spaced above the bottom centers of the troughs to deflect rounds away from direct hits in the non-deflective bottom dead center zone of the troughs.

A third alternate embodiment provides a closely spaced, connected array of U-section channel members having triangular deflecting members disposed to cover the gap left between the openings of each U-section channel member.

A fourth alternate embodiment provides an array of closely spaced, connected funnel-like members that are further connected as pairs at their bottom dead centers by reduced diameter tubing. Tensoidal deflecting members cover the gaps between the adjoining openings of the funnel-like members.

A fifth alternate embodiment provides, as a variation on the preferred best mode, an additional lower "layer" of U-shaped tubular members. The openings to the bottom layer of the U-shaped tubular members are joined to the bottom dead center portion of adjoining pairs of U-shaped tubular members in the upper layer, wherein the junction, defined by a hole, has a diameter equal to the substantially flat portion of the bottom curve of the upper U-shaped tubular members. The additional pathway serves to further absorb energy from the incoming projectiles by providing a longer route of travel, in addition to protecting the flatter portions of the upper U-shaped members from a direct piercing impact.

A sixth alternate embodiment provides, as a variation on the third alternate embodiment, a slot opening in the bottom dead center of each U-section channel member, axially aligned with the openings of a lower layer of U-section channel members that are disposed to joined the upper layer at the substantially flat portion of its bottom curved surface.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

FIG. 1 shows the armor plate assembly 1 as a series of side by side connected redirecting members 2. The redirecting members 2 are shown in a generic trough-like or U-shaped form. The redirecting members are supported in a rigid, spaced open framework 3 and optional base member 4. The framework 3 or the base 4 is secured to a variety surfaces, such as a building wall, a hand held protective shield, the sides of a vehicle, etc. It should be understood that while only three redirecting members 2 are shown in series in FIG. 1, this is merely a small portion of the overall armor plating assembly 1 that is required to cover the object/surface to be protected. This is also true of the other embodiments shown in FIGS. 2–7.

The three generic U-shaped redirecting members **2*a*, 2*b*, and 2*c* illustrate the use of three different materials of construction and their different physical characteristics. The left redirecting member 2*a*** comprises a laminate of several different materials such as high density steel honeycomb, balsa wood, fiberglass reinforced plastic, ballistic nylon/KEVLAR, and steel plating. This type of composite configuration has an enhanced structural integrity and is able to withstand greater blast forces that would normally induce fractures and deformation in ordinary armor plating.

The center redirecting member **2*b* utilizes a metal mesh construction. The metal mesh robs the incoming small arms fire of energy by absorbtion. As the bullets hit the mesh, the mesh gives slightly under the force of the impact absorbing some of the kinetic energy of the bullet. The velocity of the bullets is further retarded by friction between the bullet and the mesh causing the continual abrading away of portions of the exterior of the individual bullets as they follow the curvature of the metal mesh redirecting member 2*b*. As best seen in the side elevation view of FIG. 2C, the metal mesh redirecting member 2*b* is stabilized by lines 5** that enable the mesh-type redirecting member to retain its shape when oriented vertically.

Referring again to FIG. 1, the right redirecting member **2*c* shows the use of metal. The preferred metal is a hardened steel having a sufficient thickness to resist deformation caused by a wide range of small arms fire. Incoming bullets are deflected and redirected at most angles of incidence due to a ricochet effect that is greatest in the metal embodiment 2C. In addition, a teflon coating, or some other like surface treatment, may be applied to the redirecting surface 6 of the firmer laminate and metal redirecting members, 2*a* and 2*c* respectively, to minimize the coefficient of friction between the redirecting surfaces 6 and incoming small arms fire. By making the redirecting surface 6 "slippery", the overall redirecting properties of the armor plate assembly 1** are enhanced.

While the redirecting members are referred to as "U-shaped" or "trough-like" and are depicted as being semicircular in cross-section, it should be understood that they may also be parabolic, semi-elliptical yor hyperbolic in cross-section.

FIGS. 2A–2C show a more complex variation of the generic U-shaped redirecting members 2 of the FIG. 1 embodiment. In FIG. 2A each redirecting member 2 is a U-shaped tubular channel having two rectangular openings **7*a*, 7*b* adapted to receive and/or redirect incoming small arms fire and a deflector 8 having a base 9 dispose above the dead center of the channel to form the two openings 7*a*, 7*b*. The size of the openings, as is typical for all embodiments of this invention, range from 2 to 6 inches in width (i.e. transverse to the channel axis). In other words, the width of the channel opening of the U-shaped channel or the diameter of the round opening of the U-shaped tube ranges from 10–100 times the diameter of an individual incoming bullet. The deflectors 8 of this embodiment are prisms, triangular in cross section, preferably constructed of a suitably hardened steel. The deflectors 8 of this embodiment may be solid triangular prisms, hollow triangular channels, or two sided angles (i.e. no base 9), and may be permanently attached to the end panels 24*a*, 24*b* (see FIG. 1) of various types of redirecting members 2*a*, 2*b*, and 2*c* by welding brazed joints, high strength epoxies, or other like securing means. As an alternative to permanently mounted deflectors where damage may result from unusually heavy or excessive direct impact arms fire, replacement of deflectors 8** is easily accomplished by using slotted tabs, machine screws or other like detachable fastening means.

FIG. 2C shows the apexes **17*a* of each deflector 8 pointing toward the direction of fire outward from the plane of the openings 7. The angled sides 10 of the deflectors 8 function to guide incoming small arms fire to one of the openings 7*a* and 7*b*, and, in addition, function to protect the substantially flat bottom dead center portion there below of the lower curved member 11 from a potential piercing or deformation due to a direct impact by a bullet. Where the deflectors 8 are triangular including angled sides 10 (and optional base 9 combined with the added material of the optional upper curve members 12), they create a substantial shadow region for the lower curve 11 over a wide range of angles of incidence of incoming rounds. In other words, fewer bullets make initial contact with the center of lower curved member 11 due to the buffer offered by the upper curved member 12 and the deflector 8. The majority of incoming small arms fire are selectively directed to either opening 7*a*, 7*b* by initial contact with the angled sides 10 of the deflector 8, thereby entering the redirecting members 2** at a desired angle of incidence wherein the rounds are redirected back towards the source of fire or off at a harmless angle.

The unpredictable occurrence of dangerously redirected returned fire, or a ricochet, may prove to be a physical as well as psychological deterrent to attackers who fire small arms at a person, vehicle, building or some other object which is protected by such a return-fire armor plate assembly of this invention. That is, the attackers may be physically as well as psychologically deterred by return of their own fire by the static armor plate assembly of this invention.

In FIG. 3, the preferred embodiment, the redirecting members 2 are U-shaped round tubes organized in a closely spaced array, wherein tensoidal deflectors 18 occupy the interstices 14 between adjacent openings **7*a*, 7*b*, 7*c*, 7*d*, etc. The tensoidal deflectors 18, herein referred to as "tensoids", project outwardly in the direction of incoming small arms fire and comprise an optional base 15, and three or four concave sides 16 which terminate in an apex 17***b*. As is best seen in FIG. 3B, the interstices 14 (gaps) between the closely spaced tube openings are very small. In this arrangement the three concave sides 16 of the tensoids 18 appear as extensions of the round openings 7 providing a functionally smooth surface of entry for incoming small arms fire (see FIG. 3C). The preferred material for the U-shaped round tube redirecting members 2 and tensoids 18 is a suitably hardened steel.

FIGS. 4A–4C show a variation of the preferred embodiment of FIGS. 3A–3C, wherein the redirecting members 2 are pairs of funnels 19 connected by a lower U-tube member 20. As in the preferred embodiment, tensoids or cones 18 occupy the interstices between the closely spaced openings *7a–7e* of the redirecting members 2. As best seen in FIG. 4B, from a top plan view, e.g. from an attackers straight ahead firing perspective, the armor plate assembly 1 is barely distinguishable from the U-shaped round tube/tensoidal deflector configuration of FIG. 3B, the only difference being the reduced diameter U-tube 20 in the bottom of the funnels.

The functioning of the funnel 19 and U-tube 20 combination is to minimize the bottom dead center flat portions of the armor plate assembly exposed to incoming small arms fire, e.g. the lower curved portions of the trough-like and U-shape redirecting members of the preceding embodiments. Additionally, the initial velocity of the incoming small arms fire is sought to be preserved in order to maintain a relatively high exit velocity for the redirected small arms fire. The redirecting members 2 of this embodiment are to be constructed of suitably hardened steel or some like material, that is resistant to warpage likely to be caused by excessive heat build up from bullet/side wall friction.

FIGS. 5–7 show similar variations to the first three embodiments of FIGS. 1–3, wherein an additional lower array of secondary redirecting members 21 is disposed beneath the original array, having openings 22 in place of the bottom dead portions of the curved members 11 of the redirecting members 2. Thus, these relatively vulnerable portions of the curved surfaces themselves have redirecting members to redirected incoming rounds at substantial exit velocities.

Figure 5B:
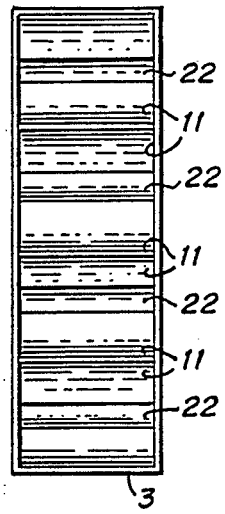
FIG. 5B is a top plan view of the fifth embodiment of the invention of FIG. 5A.
Figure 5C:
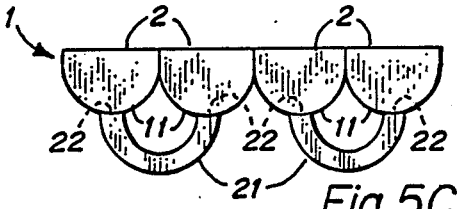
FIG. 5C is a side elevation view of the fifth embodiment of the invention of FIG. 5A.

FIGS. 5A–5C show pairs of the trough-like redirecting members 2 of FIG. 1 having attached at the bottom dead center of curved member 11, the secondary sub-redirecting members 21. A framework 3 and base 4 are used as before to support the redirecting member configuration. The various materials of construction mentioned above are also applicable here. As best seen in FIGS. 5A and 5B, the openings 22 of the secondary array of sub-redirecting members 21 appear as slots to incoming small arms fire.

Figure 6A:
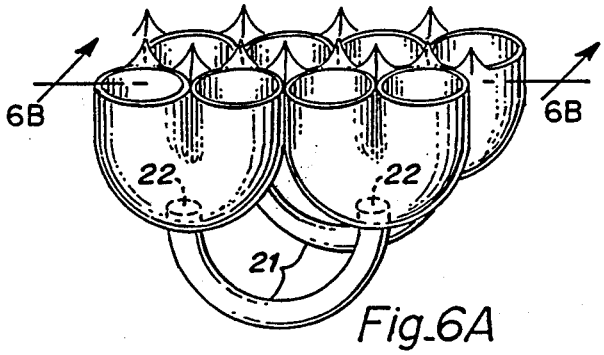
FIG. 6A is a perspective view of a sixth embodiment of the invention showing an array of U-shape round tubes and the intersticial inverted deflectors cones of FIG. 3A having pairs of adjacent U-shaped round tubes interconnected at the bottom curve of each tube by additional U-shaped round tubes.
Figure 6B:
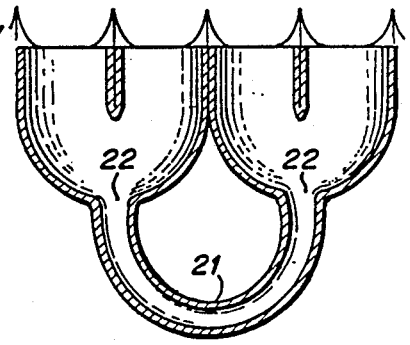
FIG. 6B is a side section view of the sixth embodiment of the invention taken along line 6B—6B of FIG. 6A.

FIG. 6A and 6B show another lower secondary array of U-shaped tubular redirecting members 21 having openings 22. The secondary assembly 21 are attached to the bottom dead center portions of the lower curved members 11 of pairs of the redirecting members 2 of the FIG. 3 preferred embodiment. Accordingly, the openings 22 of the sub-redirecting members 21 are circular.

Figure 7A:
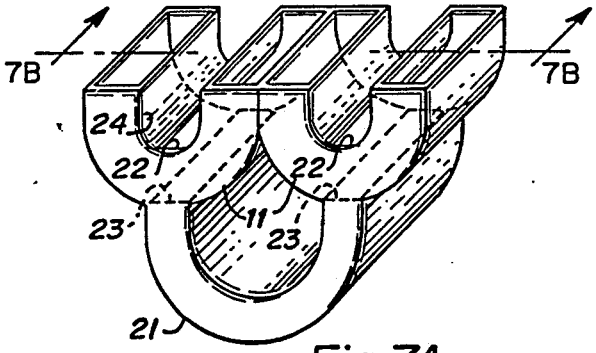
FIG. 7A is perspective view of a seventh embodiment of the invention showing an array of trough-like, U-section tubular channels, each of which has an open slot disposed at the bottom; a second underlying layer of U-section channels, connects successive pairs of the upper layer U-section channels by a junction at the bottom curve of each upper layer U-section channel.
Figure 7B:
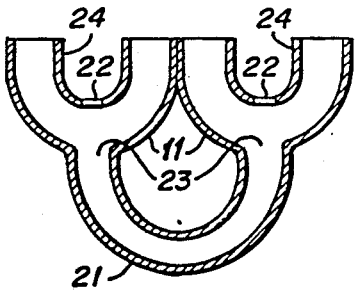
FIG. 7B is a side section view of the seventh embodiment taken along line 7B—7B of FIG. 7A.

FIGS. 7A and 7B show another lower secondary array of U-shaped channel-shaped redirecting members 21 having two openings 22 each of which is attached to the bottom dead center portion of the lower curved member 11 of pairs of redirecting members 2 of the FIG. 2 embodiment. The deflectors 8 are omitted in this embodiment. An additional slot 23 is disposed in the center portion of the upper curved member 24 of the original redirecting member 2, and is axially aligned with the openings 22 (which are also slots in this embodiment) of the lower redirecting member 21.

It should be understood that various modifications within the scope of this invention can be made by one of ordinary skill in the art without departing from the spirit thereof. The seven embodiments of this invention are merely suggestive of a large possible number of variation of this type of small arms fire redirecting Armor Plate assembly. For example, J-shaped tubular structures, or other tubular structures having bends ranging from 90°–180°, may be substituted for the U-shaped tubular structures. These achieve the desired result of protection against small arms fire by redirecting the incoming projections off at a harmless angle. I therefore wish my invention to be defined by the scope of the appended claims as broadly as the prior art will permit, and in view of the specification if need be.

I claim:

1. An armor plate assembly for protection against small arms fire comprising in operative combination:

(a) a plurality of means for guidingly redirecting incoming rounds of small arms fire, each of said redirecting means comprising at least one first curved surface disposed and sized to intercept individual ones of said incoming rounds and to redirect the flight path thereof in a direction away from said assembly so that the resultant deflection creates a shadow zone in association with said assembly;

(b) means for supporting said plurality of redirecting means in a rigid closely packed array to minimize openings therebetween, said support means including a base member disposed in association with said redirecting means to facilitate a field installation of said assembly;

(c) said redirecting means include deflectors disposed adjacent said openings between adjacent redirecting means in said array to deflect a substantial number of incoming small arms fire away from any resultant interstitial gaps between said openings;

(d) said redirecting means comprises a plurality of individual redirecting members each of which redirecting members is U-shaped in cross section; and (e) each of said U-shaped redirecting members has at least two curved surfaces and at least two openings, one for receiving and one for exiting said incoming fire, and at least said receiving openings lie substantially in a common plane.

2. An armor plate assembly as in claim 1 wherein:

(a) said U-shaped redirecting members are round tubes; and (b) said deflectors are tensoidal members.

3. An armor plate assembly as in claim 1 wherein:

(a) said U-shaped redirecting members are trough-like channels; and (b) said deflectors are members triangular in cross-section.

4. An armor plate assembly as in claim 1 wherein a second array of U-shaped redirecting members is disposed beneath said first array, each of said second array redirecting members having at least two openings, each of said openings is disposed in a bottom dead center portion of each of said first array redirecting members so that a direct impact of said incoming arms fire with any substantially flat portion of said curved surface in said first array is substantially eliminated.

5. An armor plate assembly as in claim 2 wherein a second array of U-shaped redirecting members is disposed beneath said first array, each of said second array redirecting members having at least two openings, each of said openings is disposed in a bottom dead center portion of each of said first array redirecting members so that a direct impact of said incoming arms fire with any substantially flat portion of said curved surface in said first array is substantially eliminated.

6. An armor plate assembly as in claim 3 wherein a second array of U-shaped redirecting members is disposed beneath said first array, each of said second array redirecting members having at least two openings, each of said openings is disposed in a bottom dead center portion of each of said first array redirecting members so that a direct impact of said incoming arms fire with any substantially flat portion of said curved surface in said first array is substantially eliminated.

7. An armor plate assembly as in claim 1 wherein said surface is fabricated from a metal mesh of sufficient weave tightness so that contact between said incoming small arms fire with said metal mesh results in a reduction of momentum and impact force of said arms fire by an abrading away of the outer shell material of individual ones of said arms fire.

8. An armor plate assembly as in claim 1 wherein said surface is steel of a suitable hardness to redirect said incoming small arms fire without substantial penetration of said steel surface.

9. An armor plate assembly as in claim 1 wherein said surface is fabricated from a bullet-resisting laminate.

10. An armor plate assembly as in claim 7 wherein said metal mesh is held in place by securing lines attached at selected places along the outer surface of said metal mesh to said base member.

11. An armor plate assembly as in claim 3 wherein:

(a) said surface is fabricated from a metal mesh of sufficient weave tightness so that contact between said incoming small arms fire with said metal mesh results in a reduction of momentum and impact force of said arms fire by an abrading away of the outer shell material of individual ones of said arms fire; and (b) said metal mesh is held in place by securing lines attached at selected places along the outer surface of said metal mesh to said base member.

12. An armor plate assembly as in claim 3 wherein:

(a) said surface is fabricated from a metal mesh of sufficient weave tightness so that contact between said incoming small arms fire with said metal mesh results in a reduction of momentum and impact force of said arms fire by an abrading away of the outer shell material of individual ones of said arms fire; and (b) said metal mesh is held in place by securing lines attached at selected places along the outer surface of said metal mesh to said base member.

13. An armor plate assembly as in claim 2 wherein said surface is steel of a suitable hardness to redirect said incoming small arms fire without substantial penetration of said steel surface.

14. An armor plate assembly as in claim 3 wherein said surface is steel of a suitable hardness to redirect said incoming small arms fire without substantial penetration of said steel surface.

15. An armor plate assembly as in claim 2 wherein said surface is fabricated from a bullet-resisting laminate.

16. An armor plate assembly as in claim 3 wherein said surface is fabricated from a bullet-resisting laminate.

17. An armor plate assembly for protection against small arms fire comprising in operative combination:

(a) means for guidingly redirecting said incoming rounds of small arms fire, said redirecting means comprising a plurality of individual redirecting members, each of said redirecting members comprise a round tube, J-shaped in cross section, having an opening disposed and sized to intercept individual ones of said incoming rounds, and said J-shaped tube functioning to redirect the flight path thereof in a direction away from said assembly so that the resultant deflection creates a shadow zone in association with said assembly;

(b) means for supporting said plurality of J-shaped tubular redirecting members in a rigid, closely-packed array wherein the resultant interstitial gaps created between said openings of said J-shaped tubular redirectings are minimized and said openings lie substantially in a common plane;

(c) means for deflecting a substantial number of said incoming rounds directed towards said interstitial gaps, said redirecting means comprising tensoidal members oriented normal to and disposed adjacent the plane of said openings and towards the direction of said incoming fire.

* * * * *